US005525087A

United States Patent [19]

Chin-Lin

[11] Patent Number: 5,525,087

[45] Date of Patent: Jun. 11, 1996

[54] TOY AEROPLANE

[76] Inventor: Hsu Chin-Lin, 11F-1, No.95-8, Chang Ping Road, Sec. 1, Peitun District, Taichung, Taiwan

[21] Appl. No.: 393,942

[22] Filed: Feb. 21, 1995

Related U.S. Application Data

[63] Continuation of Ser. No. 121,764, Sep. 16, 1993, abandoned.

[51] Int. Cl.[6] ..... A63H 27/22

[52] U.S. Cl. ..... 446/59; 446/58

[58] Field of Search ..... 446/57-60, 66

[56] References Cited

U.S. PATENT DOCUMENTS

| | | | |
|---|---|---|---|
| 970,829 | 9/1910 | Humphrey et al. | 446/59 |
| 2,275,094 | 3/1942 | Taylor | 446/66 |
| 2,437,743 | 3/1948 | Hojnowski | 446/58 |
| 4,629,438 | 12/1986 | McAneny | 446/58 |

FOREIGN PATENT DOCUMENTS

| | | | |
|---|---|---|---|
| 341191 | 8/1936 | Italy | 446/59 |

*Primary Examiner*—Mickey Yu

[57] ABSTRACT

A toy airplane generally has a fuselage, a nose assembly, a tail assembly, a hear train connected with a double rubber band forming a transmission mechanism, a propeller, a pair of wing seats on the fuselage, a plurality of wings and an undercarriage under the fuselage thereof. The improvement of this toy airplane is a structure that is more releasable and movable, particularly a displaceable wing structure that provides great flexibility to the operator to make their own adjustments. An undercarriage provides possible protection to the propeller from damage when landing.

6 Claims, 4 Drawing Sheets

TOY AEROPLANE

BACKGROUND OF THE INVENTION

This is a continuation application of U.S. patent application Ser. No. 08/121,764, filed on Sep. 16, 1993, now is abandoned.

The present invention relates to toy airplanes, more particularly to a structurally improved toy airplane of which the components mounted are movable, releasable and displaceable with adaptability to the outdoor environment.

Prior art toy airplanes vary in types such as a monoplane, a biplane or a triplane. Their designs are known, the simplest ones being constituted of a rubber band placed longitudinally in the fuselage of the model, the rear end of which is attached to the fuselage as the front, end is attached to the propeller.

A search for longer flights has resulted in numerous mechanical devices using several rubber bands placed parallel, or end to end with the mechanical countershafts and unwinding successively.

Finally, a number of devices include a double transmission between the rubber band and the propeller, one for winding, the other for unwinding. The transmission selection is either automatic by means of pawls, or manual, by axial movement of the propeller for example. These mechanisms are complex, often fragile. However, they have the same disadvantage of solid structure that couldn't adjust or adapt to the outdoor environment.

SUMMARY OF THE PRESENT INVENTION

The principal object of the present invention is to provide a gliding toy airplane which has a synchronized double winding rubber power mechanism and which is either monoplane, biplane or triplane in structure, and which is structurally changeable to allow assembly and disassembly for adaptation to the outdoor environment.

Accordingly, the toy airplane of the present invention comprises generally a nose assembly, a tail element, a fuselage frame of a pair of parallel spars, a gear train, a propeller, a pair of wing seats with a plurality of wings and an undercarriage.

The nose assembly is an open housing in oval form defining a chamber for receiving a gear train therein, and comprising a pair of protruding sockets on its rear, a protruding journal on its front, and a pair of spaced apertures thereof on both side at their corresponding positions for securing of the gear train and connecting with the propeller and the fuselage frame respectively.

The tail element, which is composed of an L-shape support, a fixed horizontal stabilizer, and a removable vertical fin, has also a pair of corresponding protruding sockets thereof for connecting the rear end of the fuselage frame.

A pair of wing seats, which are soached by a predetermined distance, are sleeved on the fore portion of the fuselage frame, having sockets formed on the top and bottom ends for connection of the wings which may be of the monoplane, biplane or triplane type.

An undercarriage comprising a pair of extended wheels is secured to protruding socket of the fuselage frame at the fore portion thereof.

Finally, a pair of rubber bands suspend at their ends from the shafts of the gear train and their other ends from the retaining rings adjacent to the tail element.

The features of this invention are characterized in that most of the important pieces thereof are removable or displaceable so as to facilitate the users to perform desired adjustments themselves while adapting to the outdoor environment.

The present invention will be more fully understood by reference to the following detailed description thereof when read in conjunction with the attached drawings.

DETAILED DESCRIPTION OF THE PREFERRED EMBODIMENT OF THE PRESENT INVENTION

Figure 1:
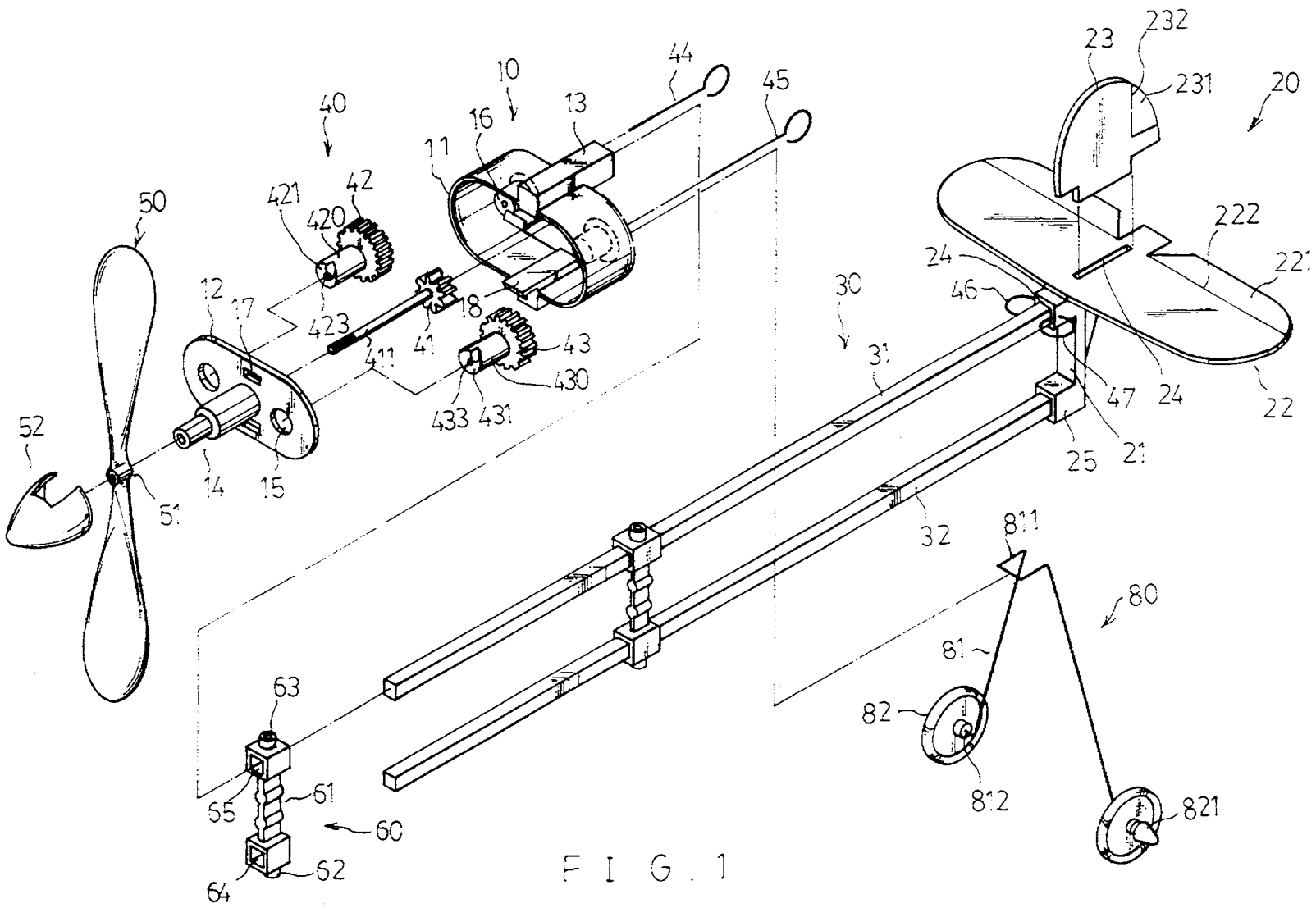
FIG. 1 is an exploded perspective view of a preferred embodiment of the present invention.
Figure 2:
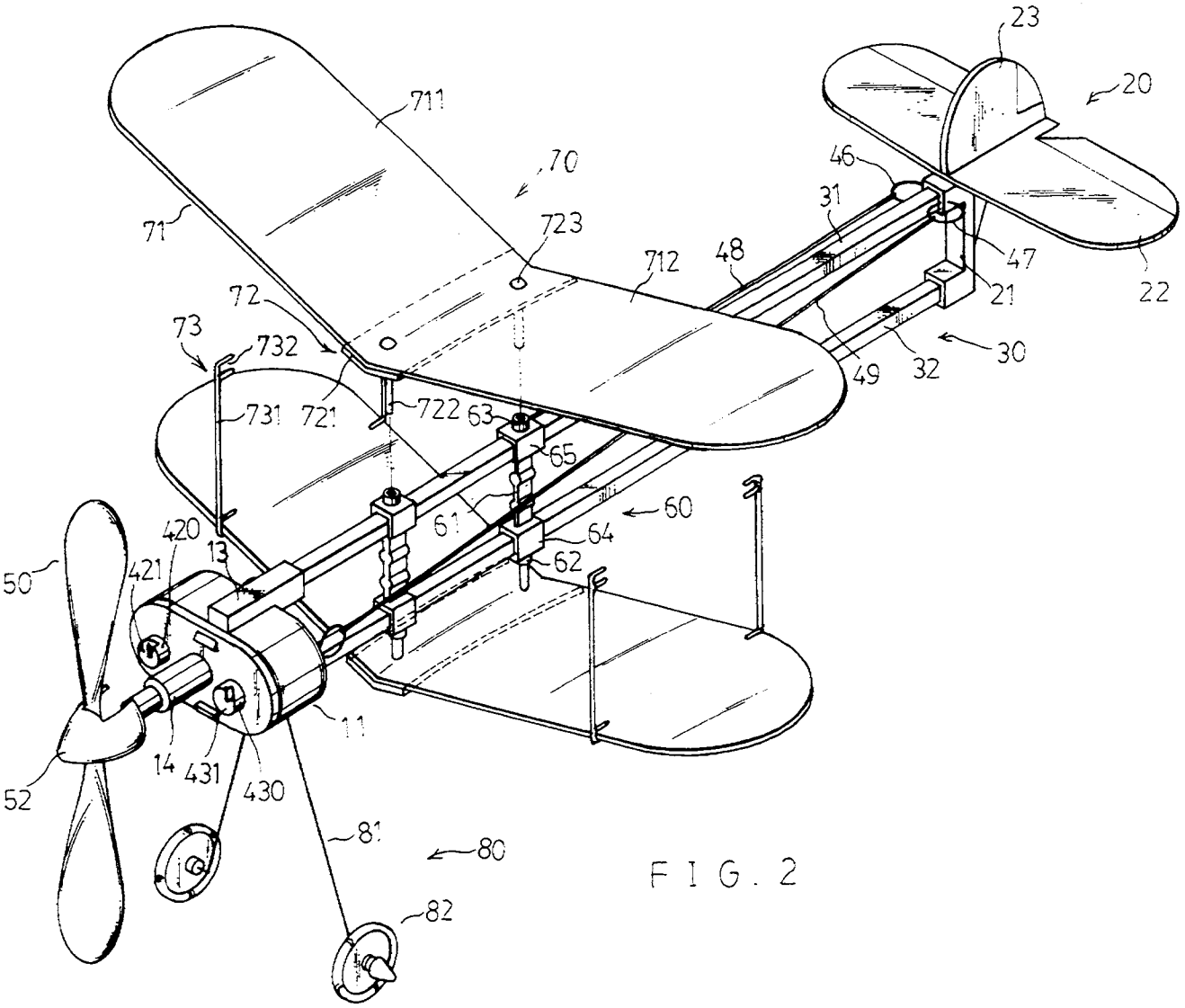
FIG. 2 is a perspective view of the preferred embodiment of the present invention of the biplane type.

Referring to FIGS. 1 and 2 of the drawings, the toy airplane of the present invention is comprised of a nose assembly 10, a tail assembly 20, a fuselage frame 30, a gear train 40, a propeller 50, a pair of wing seats 60, a wing assembly 70 and an undercarriage 80.

The nose assembly 10 is comprised of an open housing 11 in oval form and a cover 12 snap fitted on the front side thereof.

The housing 11 has a pair of protruding sockets 13 centrally formed on the top and bottom of the outer periphery slightly extending along the axis of the airplane, a pair of axle apertures 16 spacedly formed on the rear surface and a pair of spring nabs 18 formed opposite each other at the front edge abutting the protruding socket 13. The cover 12 having backward flange on periphery has a protruding journal 14 extending from the center of the front surface, a pair of circular holes 15 spacedly formed at predetermined positions at the lateral ends thereof and in registry with the corresponding aperture 16 of the housing 11 and a pair of rectangular slots 17 formed adjacent the flange of the top and bottom thereof in registry with the spring nabs 18.

The tail assembly 20 comprises a roughly L-shape support 21, a horizontal stabilizer 22 attached perpendicularly to the top portion of the support 21, and a removable vertical fin 23 insertable in a seam 24 on the top of the horizontal stabilizer 22. An elevator 221 formed on the rear end of the horizontal stabilizer 22 which can be turned up or down along the line 222, and a rudder 231 formed on the rear portion of the vertical fin 23, which can be turned laterally along the line 232. A pair of rectangular protruding sockets 24 and 25 are spacedly formed on the vertical portion of the support 21 which are positioned in registry with protruding sockets 13 of the nose assembly 10.

The fuselage frame 30 comprises a pair of rectangular spars 31 and 32 disposed parallel at upper and lower position and secured on their front ends into the pair of protruding sockets 13 and their rear ends into the protruding sockets 24 and 25 respectively. A pair of wing seats 60 are mounted on the pair of spars 31 and 32 at predetermined positions, which can be adjusted for a variety of possible flight patterns.

The gear train 40 comprises a pair of transmission gears 42 and 43 of equal diameter engaged with a gear 41 having a central extending shaft 411 therein between which is of a lesser diameter than the gears 42 and 43. Both the gears 42 and 43 have their axle rods 420 and 430 perpendicularly extended from their central front portion, each having a central recess 421 and 431 and an indentation 423 and 433 on their free ends. A pair of axle shafts 44 and 45 are inserted through their respective recesses 421 and 431 via the rear portion of the axle apertures 16 on the rear of the housing 11 and are bent to correspond with the indentations 423 and 433 of the gears 42 and 43. The three gears 41,42 and 43 of the gear train 40 are juxtaposed and mutually engaged in the housing 11 of the nose assembly 10 with the gear 41 positioned in the center thereof. The shaft 411 and axle rods 420 and 430 point forward and extend through the central openings of the protruding journal 14 and the circular holes 15 on the cover 12. The gears 41, 42 and 43 are housed within the housing of the nose assembly 10 and se cured within by the snap fitting of cover 12.

The propeller 50 is attached to the front end of the shaft 411 and retained by a spinner 51. The spinner 51 and the front end of the shaft 411 are protected from damage by the nose cone 52.

The wing seats 60 each comprise a vertical spacer 61, with a pair of rectangular sheaths 64 and 65 on opposite ends thereof, and a pair of tubular extensions 62 and 63 protruding out from the top of the sheath 65 and the bottom of the sheath 64. The open central portion of the sheaths 64 and 65 run front to back in registry with the protruding sockets 24 and 25 of the tail assembly 20 and the protruding sockets 13 of the nose assembly 10.

The wing assembly 70 is comprised of a wing member 71 of a pair of medially and equally separated sections 711 and 712 in identical form combined by tapes therebetween on the top and under side thereof to a slightly uprising plate 721 of a base seat 72, a pair of cylindrical plugs 722 perpendicularly protrude from the under side of the plate 721 at a predetermined space along a longitudinal line with a pair of circular recesses 723 at their upper ends where the plugs 722 are secured to the plate 721, and a plurality of ribs 73 which are provided for vertical support in between the two wings, preventing wing deformation. Each rib 73 comprises a straight cylindrical portion 731 and a pair of clips 732 on each end thereof for securing the wings at fixed even spaces from each other.

The undercarriage 80 comprises a pair of oblique cylindrical supports 81 having a transverse portion 811 on the upper end in a longitudinal direction relative to the plane axis and a pair of transverse portions 812 on the lower end thereof in a lateral direction, and a pair of wheels 82 perpendicularly telescoped in rotation onto the transverse portions 812 and retained by a conical means 821. The supports 81 are connected at their upper ends to the lower portion of the nose assembly 10.

The wing seats 60 are placed at predetermined positions on the pair of spars 31 and 32 of the fuselage 30, in registry with the cylindrical plugs 722 of the wing assembly 70, then, the nose assembly 10 including the propeller 50 therewith secured respectively on protruding sockets 13 together with the undercarriage 80 onto the force ends of the fuselage 30 in the manner that the transverse portion 811 on the top of the undercarriage 80 is wedged along with the lower spar 32 into the respective lower protruding socket 13, into a pair of seams on the inward surface of the lateral walls of the socket 13. The protruding sockets 24 and 25 of the tail assembly 20 are then secured onto the respective spare 31 and 32 at the rear end of the fuselage 30. Finally, a pair of wing members 70 are secured by way of the cylindrical plugs 722 into the pair of tubular sockets 62 and 63 of the wing seats 60, and supported on their lateral sides by two pairs of the ribs 73. A toy biplane is therefore assomplished after a pair of rubber bands 48 and 49 are tensionally secured on their front ends to the respective shafts 44 and 45 of the nose assembly 10 and their rear ends to the respective retaining rings 46 and 47 mounted on the upper portion of the support of the tail assembly 20.

When in operation, is to adjust the longitudinal position of the wing members 70 along the spars 31 and 32 and to turn slightly the elevator 221 or the rubber 231, then to wind the propeller 50 with finger so as to twist the pair of rubber bands 48 and 49 which are connected to the transmission gears 42 and 43. When the operator releases his hands, the rubber bands 48 and 49 immediately release their reserved energy, thereby performing flight. The toy airplane of the present invention could fly a longer distance and at a higher speed because of the double rubber bands 48 and 49 and the synchronized rotation of the gear train 40.

When landing, the undercarriage 80 will prevent the propeller 50 from touching the ground, therefore providing protection to the propeller 50 from damage.

Figure 3:
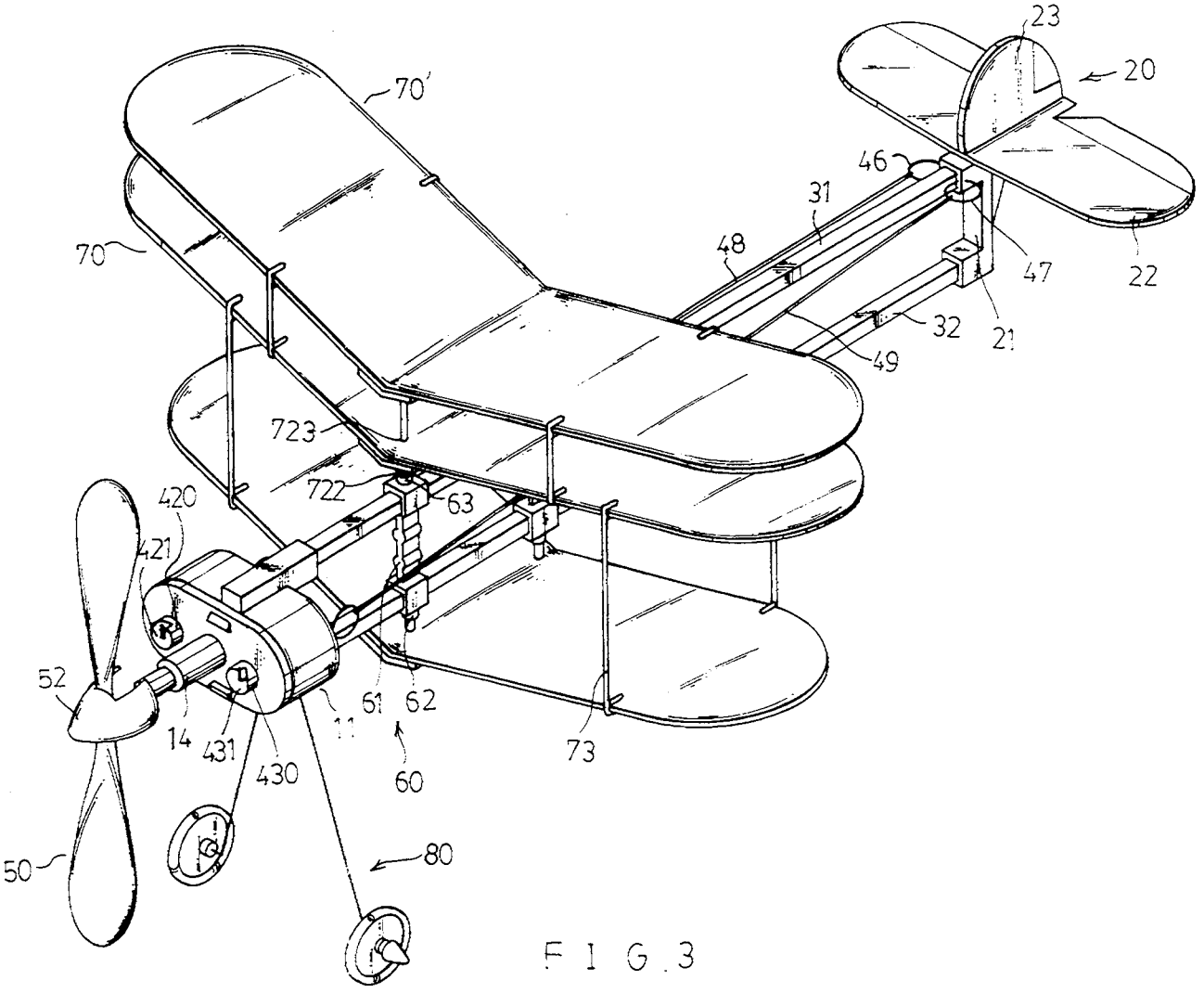
FIG. 3 is a perspective view of a second embodiment of the present invention of the triplane type.

Referring to FIG. 3 of the drawings, which shows an alternative embodiment of the present invention illustrating an identical wing assembly 70' mounted on a biplane of the present invention forming a triplane. The addition of an identical wing assembly above the upper wing assembly of a biplane is accomplished by the insertion of the cylindrical plugs 722 of the added wing assembly 70' into the spaced circular recesses 723 provided on the top of the upper wing assembly 70 and supported by additional pairs of the ribs 73. This reformation would improve the flight stability and provide greater interest to the operator.

Figure 4:
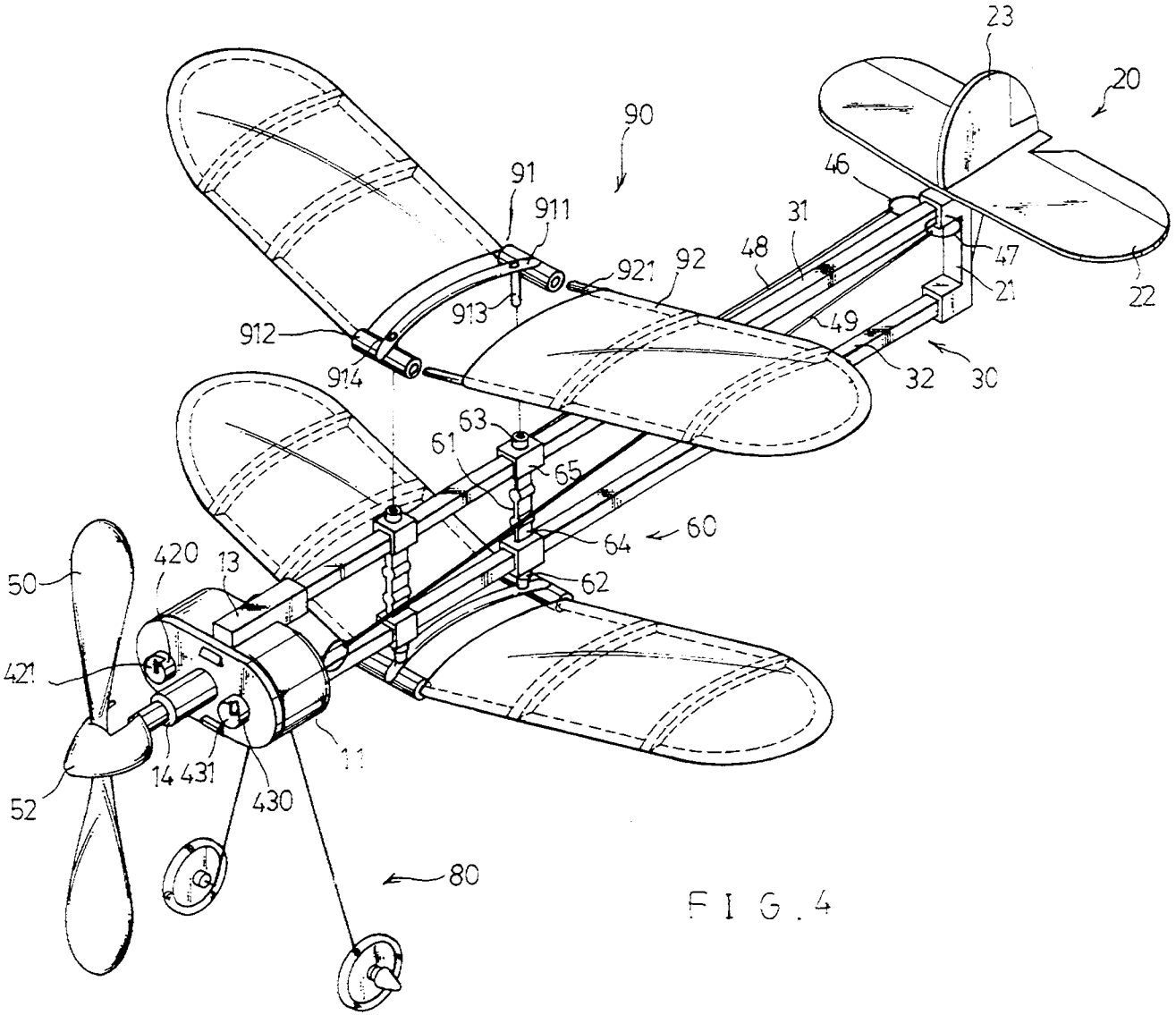
FIG. 4 is a perspective view of a third embodiment of the present invention, showing an alternative wing style.

Referring to FIG. 4 of the drawings, which shows another alternative embodiment of the wing assembly for the toy airplane of the present invention. The wing assembly 90 comprise a roughly I-shape seat 9I and a pair of identical wing elements 92 made of paper and bamboo which are combined together with the seat 91. The seat 91 is comprised of a slightly curved flat body 911, a pair of tubular socket 912 perpendicularly connected at both ends, a pair of spaced cylindrical plugs 913 perpendicularly extending from the underside and a pair of circular recesses 914 spacedly formed on the top of the flat body 911. The wing element 92 has a pair of cylindrical plugs 921 thereof protruding parallel from the lateral sides of the inward edge for insertion into the respective tubular sockets 912 therein. This alternative wing structure is sizably equal to the wing assembly 70 of FIG. 2 and provides greater convenience to assembly or disassembly.

The scope of this invention should be determined by the appended claims and their legal equivalents rather than by the example given in the aforediscussed embodiments.

I claim:

1. A toy airplane, comprising:

a fuselage, hay ink a pair of parallel spars;

a nose assembly, connecting to one end of said fuselage, having an open housing and a cover; said housing having a rear surface, a peripheral wall extending from said rear surface and defining a front edge, a pair of axle apertures spacedly formed on said rear surface, a pair of protruding sockets each respectively centrally formed on a top and a bottom of said housing and slightly extending backward along the axis of said airplane, and a pair of spring nabs formed opposite each other at said front edge and abutting said sockets, said cover having a peripheral flange, a protruding journal with a central opening extruding from the center of a front surface of said cover, a pair of circular holes spacedly formed on said cover and each in registry with a respective said axle apertures of said housing; and a pair of rectangular slots adjacent said flange and each in registry with a respective said spring nabs for mounting said cover on said housing;

a gear train, comprising a pair of transmission gears engaged with a gear having a central extending shaft and a lesser diameter than said transmission gears, said transmission gears each having an axially extending axle rod which has a central recess and an indentation on a free end of said axle rod; said gear train being fitted in said housing with said lesser diameter gear positioned in a center thereof, said shaft of said lesser diameter gear and said axle rods of said transmission gears being pointed forward and extended through said central opening of said protruding journal and said circular holes on said cover respectively;

a propeller attached to a front end of said shaft of said lesser diameter gear;

a pair of axle shafts inserted through said recesses of said transmission gears via said axle apertures on said rear surface of said housing and being bent to correspond with said indentations respectively;

a tail assembly connected to the other end of said fuselage, comprising a support having a horizontal stabilizer attached perpendicularly thereon, a vertical fin attached onto said stabilizer, and a pair of retaining rings mounted on an upper portion of said support of said tail assembly; a pair of rubber bands each attached at one end to said respective axle shafts, and the other end to a respective said retaining ring;

a pair of wing seats spacedly positioned on said spars of said fuselage, each comprising a vertical spacer, with a pair of sheaths on opposite ends thereof, and a pair of tubular extensions protruding out up and downward from each of said pair of sheaths respectively, said sheaths of each of said wing seats being mounted on said spars of said fuselage respectively;

at least a wing assembly comprising a wing member mounted on a base seat, a pair of cylindrical plugs perpendicularly protruded from an underside of said base seat, said wing assembly being connected with said fuselage by inserting said cylindrical plugs into said tubular extensions of said wing seats respectively; and an undercarriage comprising a pair of oblique supports having a transverse upper portion connecting said oblique supports at upper ends thereof, said transverse upper portion secures said undercarriage to said nose assembly, a lower transverse portion extending outwardly from a lower end of each of said oblique supports, and a pair of wheels rotatably secured to said lower transverse portion.

2. A toy airplane according to claim 1, wherein said base seat is formed as a substantially I-shaped member comprising a slightly curved flat body perpendicularly connected on each end thereof with a tubular socket, said wing member comprising two identical wing halves each having a pair of cylindrical plugs respectively mounting said wing halves to said tubular sockets.

3. A toy airplane according to claim 1, wherein said base seat of said wing assembly is a slightly uprising plate.

4. A toy airplane according to claim 1 or 2, wherein said airplane comprises at least two wing assemblies and further comprises a predetermined number of ribs which are provided for vertical support in between the wing assemblies preventing wing deformation.

5. A toy airplane according to claim 4, wherein said ribs each comprises a straight cylindrical portion and a clip on each end thereof for securing said wing assemblies at fixed even spaces from each other.

6. A toy airplane according to claim 1, wherein said wing seats are displaceable along said spars of said fuselage.

* * * * *